US007737921B2

(12) United States Patent
Kim et al.

(10) Patent No.: US 7,737,921 B2
(45) Date of Patent: Jun. 15, 2010

(54) DRIVING DEVICE AND METHOD OF PLASMA DISPLAY PANEL BY FLOATING A PANEL ELECTRODE

(75) Inventors: Jin-Sung Kim, Cheonan-si (KR); Dong-Young Lee, Seoul (KR); Woo-Joon Chung, Asan-si (KR); Kyoung-Ho Kang, Suwon-si (KR); Seung-Hun Chae, Suwon-si (KR); Tae-Seong Kim, Yongin-si (KR)

(73) Assignee: Samsung SDI Co., Ltd., Suwon (KR)

( * ) Notice: Subject to any disclaimer, the term of this patent is extended or adjusted under 35 U.S.C. 154(b) by 1666 days.

(21) Appl. No.: 10/873,649

(22) Filed: Jun. 23, 2004

(65) Prior Publication Data

US 2005/0030260 A1 Feb. 10, 2005

(30) Foreign Application Priority Data

Jun. 23, 2003 (KR) ..... 2003-0040688
Oct. 9, 2003 (KR) ..... 2003-0070247
Oct. 15, 2003 (KR) ..... 2003-0071757

(51) Int. Cl.
*G09G 3/28* (2006.01)

(52) U.S. Cl. ..... 345/66; 345/68

(58) Field of Classification Search ..... 345/37, 345/41, 52, 55, 60, 61, 62, 94, 208, 210, 345/63, 66, 67, 68
See application file for complete search history.

(56) References Cited

U.S. PATENT DOCUMENTS 4,560,914 A * 12/1985 Lafonta et al. ..... 330/7
5,745,086 A 4/1998 Weber
6,249,087 B1 * 6/2001 Takayama et al. ..... 315/169.1
6,822,644 B1 * 11/2004 Awamoto et al. ..... 345/211

(Continued)

FOREIGN PATENT DOCUMENTS

EP 1065646 1/2001

(Continued)

OTHER PUBLICATIONS

European Search Report dated Feb. 4, 2008.

*Primary Examiner*—Chanh Nguyen
*Assistant Examiner*—Pegeman Karimi
(74) *Attorney, Agent, or Firm*—H.C. Park & Associates, PLC

(57) ABSTRACT

Disclosed are a driving device and a driving method for a plasma display panel (PDP). A panel capacitor is formed by a scan electrode and a sustain electrode. The charges are moved from the panel capacitor to a capacitor by turning on a transistor which is connected between the scan electrode and the capacitor. By this method, the voltage of the panel capacitor is steeply reduced so that a discharge is generated in the panel capacitor. When the voltage of the capacitor increases because of the charges moved from the panel capacitor, the gate-source voltage of the transistor is reduced. As a result, the transistor is turned off so that the scan electrode is floated. Accordingly, the discharge is steeply quenched so that the wall charges are precisely controlled. After the capacitor is discharged, the above-noted operation may be repeated.

39 Claims, 12 Drawing Sheets

U.S. PATENT DOCUMENTS

| | | | | |
|---|---|---|---|---|
| 7,009,823 | B2 * | 3/2006 | Yoon et al. | 361/15 |
| 2001/0017606 | A1 * | 8/2001 | Choi | 345/60 |
| 2002/0054001 | A1 | 5/2002 | Awamoto | |
| 2004/0012411 | A1 * | 1/2004 | Guedon et al. | 326/86 |

FOREIGN PATENT DOCUMENTS

| | | |
|---|---|---|
| EP | 1065647 | 1/2001 |
| EP | 1477957 | 11/2004 |
| WO | 00-14711 | 3/2000 |
| WO | 02-058041 | 7/2002 |

* cited by examiner

DRIVING DEVICE AND METHOD OF PLASMA DISPLAY PANEL BY FLOATING A PANEL ELECTRODE

CROSS REFERENCE TO RELATED APPLICATION

This application claims priority to and the benefit of Korean Patent Application Nos. 2003-40688, 2003-70247, and 2003-71757 filed on Jun. 23, 2003, Oct. 9, 2003, and Oct. 15, 2003, respectively, in the Korean Intellectual Property Office, the contents of which are incorporated herein by reference.

BACKGROUND OF THE INVENTION (a) Field of the Invention

The present invention relates to a driving device and method for a plasma display panel (PDP).

(b) Description of the Related Art

A PDP is a flat panel display for displaying characters or images using the plasma generated by gas discharge, and several tens to several millions of pixels are arranged in a matrix format on the PDP depending on the PDP size. The PDP is classified as a DC PDP or an AC PDP depending on the waveforms of applied driving voltages and the configurations of discharge cells.

In general, the AC PDP driving method uses a reset period, an address period, and a sustain period sequentially.

During the reset period, wall charges formed during a previous sustain period are erased, and cells are reset so as to readily perform the next address operation. During the address period, cells that are turned on and those that are not turned on are selected, and wall charges are accumulated on the turned-on cells (i.e., addressed cells). During the sustain period, a discharge is created in the addressed cells that allows the addressed cells to take part in image display. When the sustain period begins, sustain pulses are alternately applied to the scan electrodes and sustain electrodes to sustain the discharge and display the images. As used herein, the term wall charges refers to charges that accumulate on the electrodes and are formed proximate to the electrodes on the wall (e.g., dielectric layer) of the discharge cells. The wall charges typically do not actually touch the electrodes themselves because a dielectric layer covers the electrodes. However, for simplicity in description, the charges will be described herein as being "formed on", "stored on" and/or "accumulated on" the electrodes. Furthermore, the term wall voltage, as used herein, refers to a voltage potential that exists on the wall of discharge cells. The wall voltage is caused by the wall charges.

In a conventional PDP, a ramp waveform is applied to a scan electrode so as to establish wall charges in the reset period, as disclosed in U.S. Pat. No. 5,745,086. Specifically, a rising ramp waveform which gradually rises is applied to the scan electrode, followed by a falling ramp waveform which gradually falls. Since precise control of the wall charges greatly depends on the gradient of the ramp if ramp waveforms are applied, the wall charges are typically not controlled precisely during any given time frame.

SUMMARY OF THE INVENTION

Embodiments of the present invention provide PDP driving devices and methods for precisely controlling wall charges.

Embodiments according to one aspect of the present invention provide a driving device for a plasma display panel. The plasma display panel has a capacitive load formed by at least two electrodes. The driving device comprises a transistor and a capacitor. The transistor has a first main end coupled to the capacitive load, a second main end coupled to a power source for supplying a first voltage, and a control end, and is turned on in response to a first level of a control signal applied to the control end. The capacitor is provided in a path including the capacitive load, the transistor, and the voltage source. The voltage of the capacitive load is changed by the voltage difference between the voltage source and the capacitive load when the transistor is turned on. The transistor is turned off when the capacitor is charged to a second voltage while the voltage of the capacitive load is changed.

Embodiments according to another aspect of the present invention provide a driving device for a plasma display panel. The plasma display panel has a capacitive load formed by at least two electrodes. The driving device comprises a transistor, a capacitor, a control voltage source, and a discharge path. The transistor has a first main end coupled to the capacitive load. The capacitor has a first end coupled to a second main end of the transistor and a second end coupled to a voltage source supplying a first voltage. The control voltage source supplies a control voltage to a control end of the transistor. The discharge path has a first end coupled to the first end of the capacitor. The state of the transistor is determined by the first end voltage of the capacitor.

Embodiments according to still another aspect of the present invention provide a driving device of a plasma display panel. The plasma display panel has a capacitive load formed by at least two electrodes. The driving device comprises a transistor, a capacitor, a control voltage source, and a discharge path. The transistor has a first main end coupled to a voltage source supplying a first voltage. The capacitor has a first end coupled to a second main end of the transistor and a second end coupled to the capacitive load. The control voltage source supplies a control voltage to a control end of the transistor. The discharge path has a first end coupled to the first end of the capacitor. The state of the transistor is determined by the first end voltage of the capacitor.

Embodiments according to further aspects of the invention provide a driving method for a plasma display panel. The plasma display panel has a capacitive load formed by at least two electrodes. The driving method comprises turning on a transistor having a first main end coupled to the capacitive load to discharge the capacitive load and turning off the transistor when the capacitive load is discharged of a first amount of charges.

Embodiments according to yet further aspects of the present invention provide a driving method for a plasma display panel. The plasma display panel has a capacitive load formed by at least two electrodes. The driving method comprises changing a voltage of the capacitive load by using a first level of a control signal, floating the capacitive load when the voltage of the capacitive load is changed by a predetermined voltage, and maintaining the floating state of the capacitive load by using a second level of the control signal.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

A PDP driving device and method according to an exemplary embodiment of the present invention will now be described with reference to the drawings.

Figure 1:
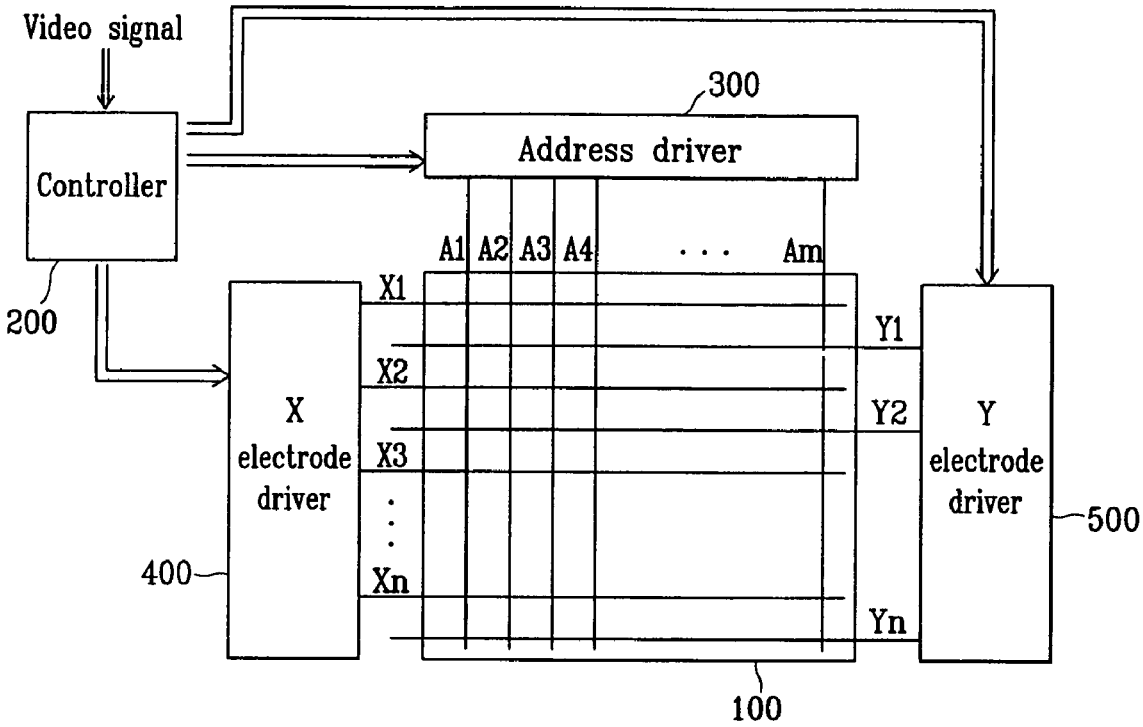
FIG. 1 is a schematic diagram of a PDP according to an exemplary embodiment of the present invention.

FIG. 1 is a schematic diagram of a PDP according to an exemplary embodiment of the present invention.

As shown in FIG. 1, the PDP comprises a plasma panel 100, a controller 200, an address driver 300, a sustain electrode driver (referred to as an X electrode driver hereinafter) 400, and a scan electrode driver (referred to as a Y electrode driver hereinafter) 500.

The plasma panel 100 includes a plurality of address electrodes $A_1$ to $A_m$ arranged in the column direction, a plurality of sustain electrodes (referred to as X electrodes hereinafter) $X_1$ to $X_n$ arranged in the row direction, and a plurality of scan electrodes (referred to as Y electrodes hereinafter) $Y_1$ to $Y_n$ arranged in the row direction. The X electrodes $X_1$ to $X_n$ are formed corresponding to the respective Y electrodes $Y_1$ to $Y_n$, and their ends are connected in common. The plasma panel 100 includes a glass substrate (not shown) on which the X and Y electrodes $X_1$ to $X_n$ and $Y_1$ to $Y_n$ are arranged, and a glass substrate (not shown) on which the address electrodes $A_1$ to $A_m$ are arranged. The two glass substrates face each other with a discharge space therebetween so that the Y electrodes $Y_1$ to $Y_n$ may cross the address electrodes $A_1$ to $A_m$ and the X electrodes $X_1$ to $X_n$ may cross the address electrodes $A_1$ to $A_m$. In this instance, discharge spaces on the crossing points of the address electrodes $A_1$ to $A_m$ and the X and Y electrodes $X_1$ to $X_n$ and $Y_1$ to $Y_n$ form discharge cells.

The controller 200 externally receives video signals, and outputs address driving control signals, X electrode driving control signals, and Y electrode driving control signals; Additionally, the controller 200 divides a single frame into a plurality of subfields and drives them. Each subfield includes, sequentially, a reset period, an address period, and a sustain period.

The address driver 300 receives address driving control signals from the controller 200, and applies display data signals to the respective address electrodes $A_1$ to $A_m$ for selecting desired discharge cells. The X electrode driver 400 receives X electrode driving control signals from the controller 200 and applies driving voltages to the X electrodes $X_1$ to $X_n$. The Y electrode driver 500 receives Y electrode driving control signals from the controller 200, and applies driving voltages to the Y electrodes $Y_1$ to $Y_n$.

Driving waveforms applied to the address electrodes $A_1$ to $A_m$, the X electrodes $X_1$ to $X_n$, and the Y electrodes $Y_1$ to $Y_n$ for each subfield will be described with reference to FIGS. 2 and 3. A discharge cell formed by an address electrode, an X electrode, and a Y electrode will be described below.

Figure 2:
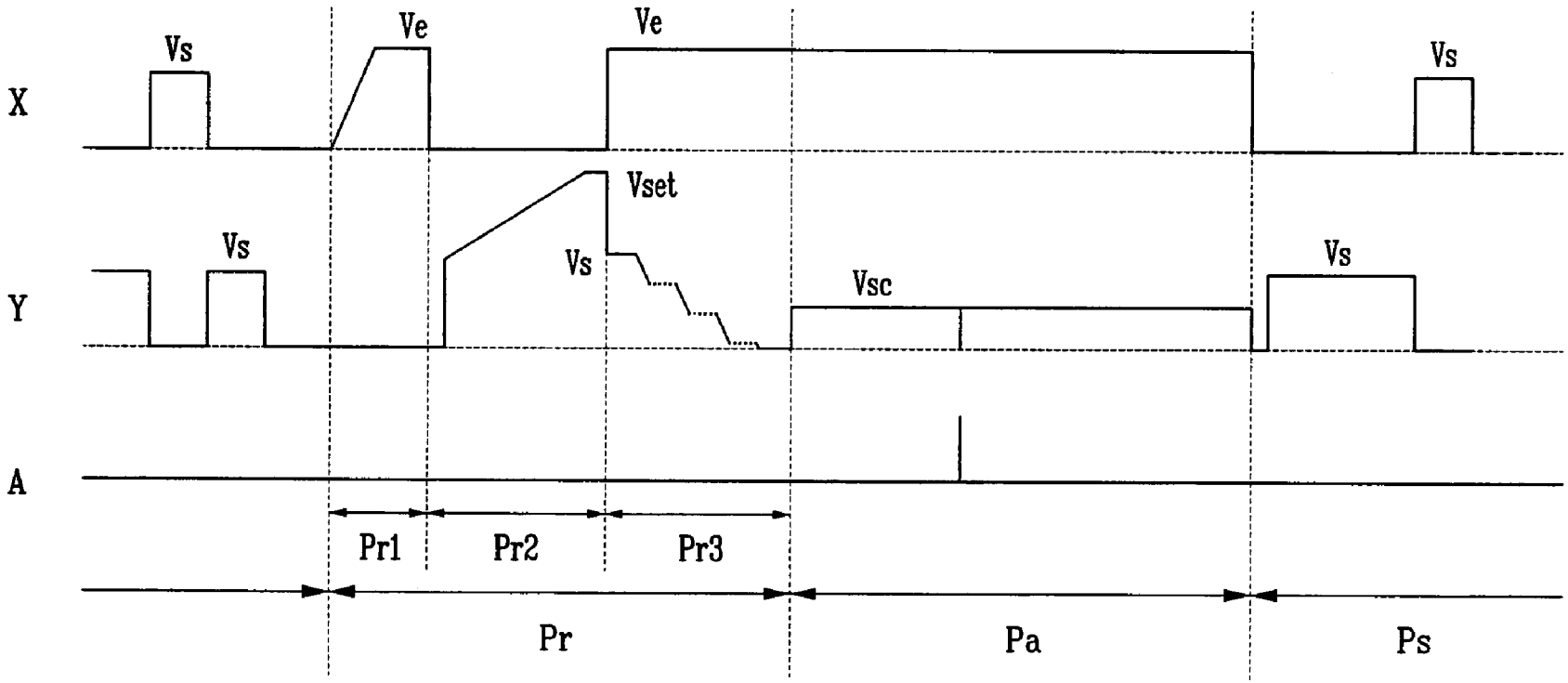
FIG. 2 is a waveform diagram illustrating a driving waveform of the PDP according to an exemplary embodiment of the present invention.
Figure 3:
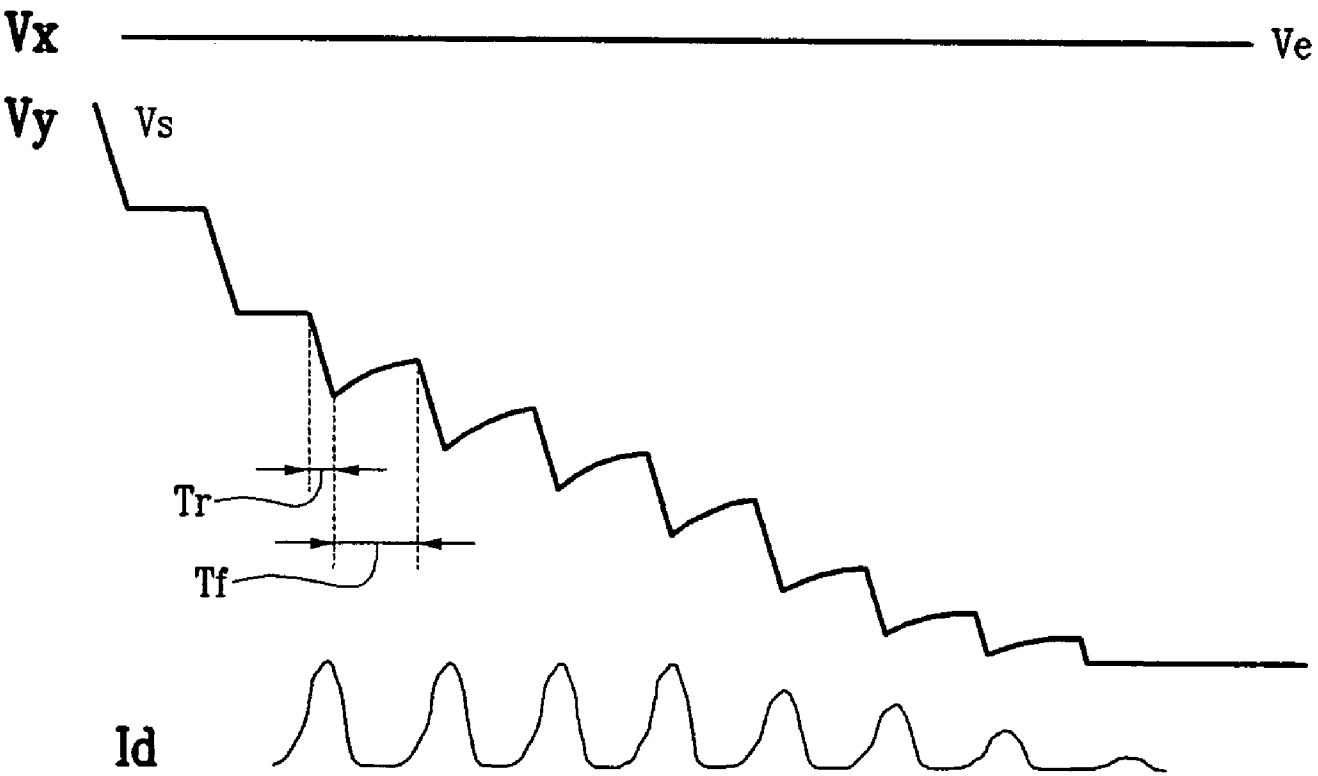
FIG. 3 is a waveform diagram illustrating a falling scan electrode voltage waveform and a discharge current waveform according to an exemplary embodiment of the present invention.

FIG. 2 is a waveform diagram illustrating a driving waveform of the PDP according to one exemplary embodiment of the present invention, and FIG. 3 is a waveform diagram illustrating a falling Y electrode voltage waveform and a discharge current waveform according to an exemplary embodiment of the present invention.

Referring to FIG. 2, a single subfield includes a reset period $P_r$, an address period $P_a$, and a sustain period $P_s$. The reset period Pr includes an erase period $P_{r1}$, a rising period $P_{r2}$, and a falling period $P_{r3}$.

In general, positive charges are formed at the X electrode, and negative charges are formed at the Y electrode when the last sustaining discharge of a sustain period is finished. A waveform rising from a reference voltage to a voltage of $V_e$ is applied to the X electrode while the Y electrode is maintained at the reference voltage after the sustain period is finished in the erase period $P_{r1}$ of the reset period $P_r$, assuming that the reference voltage is 0V (volts). The charges accumulated at the X and Y electrodes are gradually erased.

Next, a waveform rising from a voltage of $V_s$ to a voltage of $V_{set}$ is applied to the Y electrode while the X electrode is maintained at 0V in the rising period $P_{r2}$ of the reset period $P_r$. Because of this, weak resetting discharges are generated between the Y electrode and the address electrode and between the X electrode and the Y electrode, and the negative charges are accumulated at the Y electrode. Positive charges are accumulated at the address electrode and the X electrode.

As shown in FIGS. 2 and 3, a process is repeated in which the voltage applied to the Y electrode is reduced by a predetermined voltage and the Y electrode is floated by stopping the voltage applied to the Y electrode during the period of $T_f$, while the X electrode is maintained at the voltage of $V_e$ in the falling period $P_{r3}$ of the reset period $P_r$. FIG. 3 also shows the firing period $T_r$, during which voltage is applied to the Y electrode.

When the voltage difference between the voltage of $V_x$ at the X electrode and the voltage of $V_y$ at the Y electrode becomes greater than a discharge firing voltage $V_f$ while repeating this process, a discharge occurs between the X and Y electrodes. That is, a discharge current Id flows in the discharge space. When the Y electrode is floated after the discharge begins between the X and Y electrodes, the voltage of the Y electrode changes according to the amount of the accumulated wall charges because there is no electric charge supplied to the electrodes from the power source. The amount of the accumulated wall charges reduces the interval voltage of the discharge space, so the discharge is quenched with a small amount of wall charges. That is, the interval voltage of the discharge space is rapidly reduced by the wall charges formed on the X and Y electrodes so that an intense discharge quenching occurs in the discharge space. Next, when the Y electrode is floated after the voltage of the Y electrode has fallen to form a discharge, the wall charges are reduced and intense discharge quenching occurs within the discharge space. When reducing the voltage of the Y electrode and floating the Y electrode are repeated a predetermined number of times, desired amounts of wall charges are formed at the X and Y electrodes.

As described above, the exemplary embodiment quenches the discharge with a much smaller amount of wall charges to allow precise control over the wall charges, as compared with the prior art. In addition, the conventional reset method of applying a ramp voltage slowly increases the voltage applied to the discharge space with a constant voltage variation to prevent an intense discharge and control the wall charge. This conventional method of using the ramp voltage controls the intensity of the discharge using the slope of the ramp voltage and restricts the slope of the ramp to certain acceptable slope values in order to control the wall charges properly. Often, the restricted number of acceptable slope values causes the reset operation to take too long, because the ramping operation takes too long to complete.

In contrast, a reset method using a floating state $T_f$ according to an exemplary embodiment of the invention controls the intensity of the discharge using a voltage drop based on the wall charges, thereby reducing the time required to complete the reset period. Moreover, the falling time of the Y electrode voltage in embodiments of the invention is generally not long because an excessively intense discharge may occur if the voltage-applying time of the Y electrode is long.

Referring to FIGS. 4A to 4E, the intense discharge quenching caused by floating will be described below in detail with reference to the X and Y electrodes in the discharge cell, since the discharge generally occurs between the X and Y electrodes.

Figure 4A:
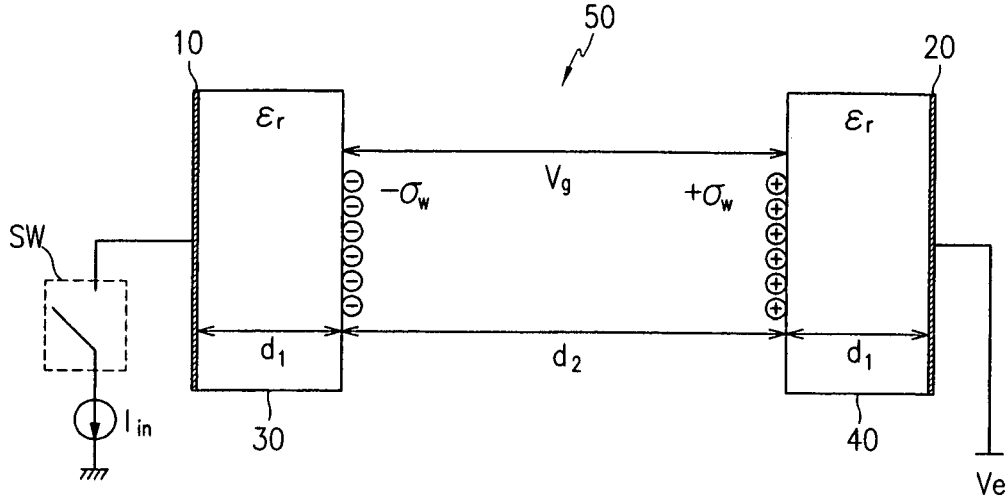
FIG. 4A is a schematic diagram of a discharge cell formed by a sustain electrode and a scan electrode.
Figure 4B:
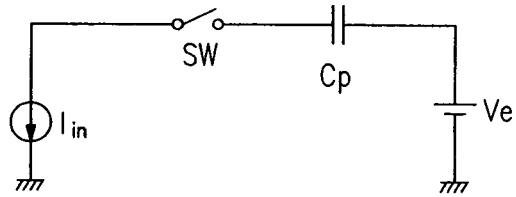
FIG. 4B is a schematic diagram illustrating an equivalent circuit of FIG. 4A.
Figure 4C:
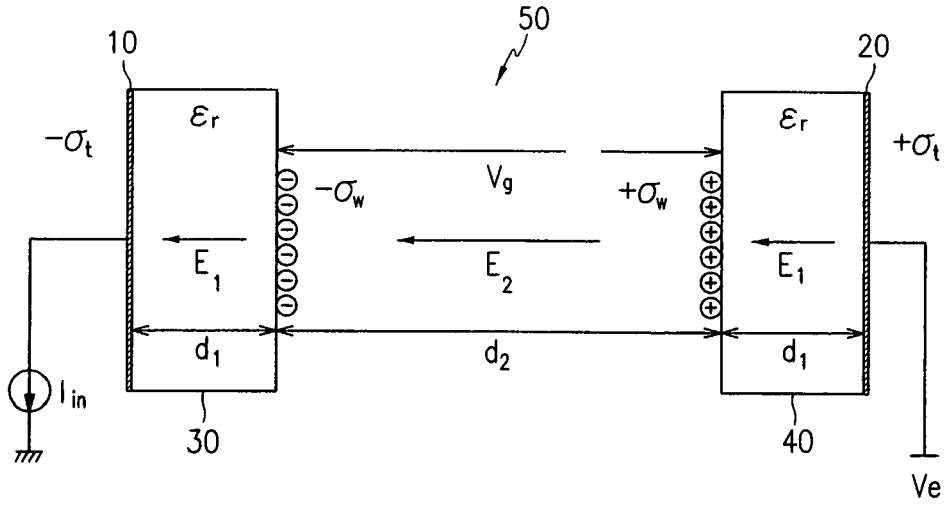
FIG. 4C is a schematic diagram similar to that of FIG. 4A illustrating a case when no discharge occurs in the discharge cell of FIG. 4A.
Figure 4D:
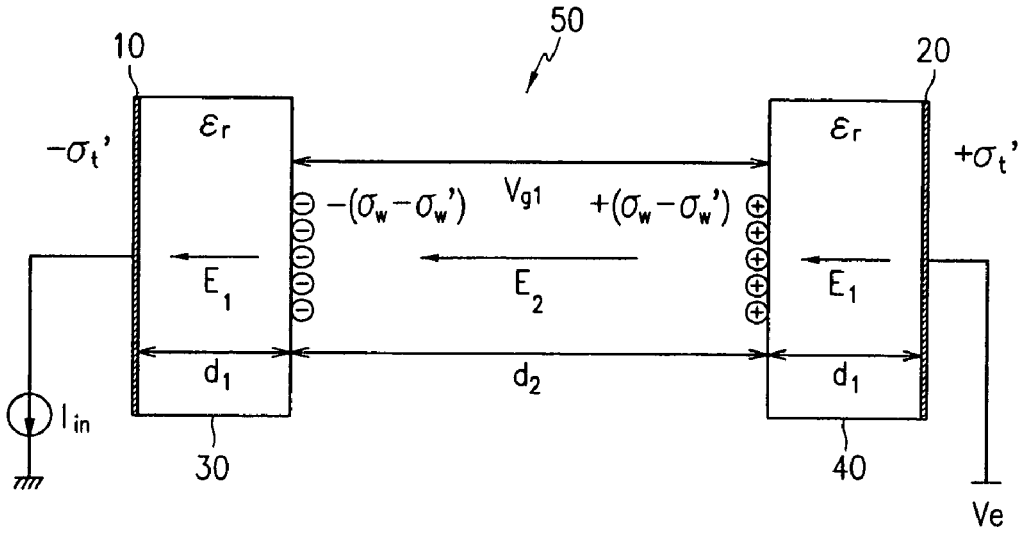
FIG. 4D is a schematic diagram similar to that of FIG. 4A illustrating a state in which a voltage is applied such that a discharge occurs in the discharge cell.
Figure 4E:
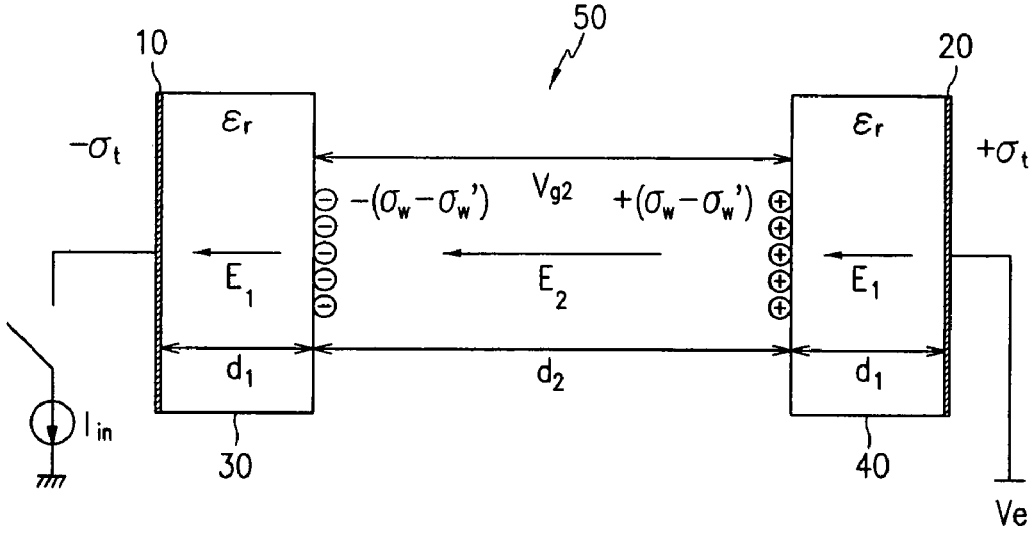
FIG. 4E is a schematic diagram similar to that of FIG. 4A illustrating a floated state when a discharge occurs in the discharge cell.

FIG. 4A is a schematic diagram of a discharge cell formed by a sustain electrode and a scan electrode. FIG. 4B is a schematic diagram of an equivalent circuit of FIG. 4A. FIG. 4C is a schematic diagram similar to that of FIG. 4A, illustrating a case when no discharge occurs in the cell. FIG. 4D is a schematic diagram similar to that of FIG. 4A, illustrating a state in which a voltage is applied when a discharge occurs in the discharge cell. Additionally, FIG. 4E is a schematic diagram similar to that of FIG. 4A, illustrating a floated state when a discharge occurs in the discharge cell of FIG. 4A. For ease of description, charges $-\sigma_w$ and $+\sigma_w$ are formed at the Y and X electrodes 10 and 20, respectively, in an earlier stage than that depicted in FIG. 4A. The charges are formed on a dielectric layer of an electrode, but for ease of explanation, the charges will be described as having been formed on the electrodes.

As shown in FIG. 4A, the Y electrode 10 is connected to a current source $I_{in}$ through a switch SW, and the X electrode 20 is connected to the voltage Of $V_e$. Dielectric layers 30 and 40 are respectively formed within the Y and X electrodes 10 and 20. Discharge gas (not shown) is injected between the dielectric layers 30 and 40, and the area provided between the dielectric layers 30 and 40 forms a discharge space 50.

Because the Y and X electrodes 10 and 20, the dielectric layers 30 and 40, and the discharge space 50 form a capacitive load, they may be represented for purposes of description as a panel capacitor Cp, as shown in FIG. 4B. The panel capacitor Cp is defined such that the dielectric constant of the dielectric layers 30 and 40 is $\epsilon_r$, a voltage at the discharge space 50 is $V_g$, the thickness of the dielectric layers 30 and 40 is the same as $d_1$, and the distance (the width of the discharge space) between the dielectric layers 30 and 40 is $d_2$.

The voltage $V_y$ applied to the Y electrode of the panel capacitor Cp is reduced in proportion to the time when the switch SW is turned on, as shown in Equation (1), below. That is, when the switch SW is turned on, the Y electrode voltage $V_y$ is reduced. In FIGS. 4A to 4E, the Y electrode voltage $V_y$ is reduced by using the current source $I_{in}$. However, the Y electrode voltage $V_y$ may be reduced by applying the falling voltage to the Y electrode or discharging the panel capacitor Cp.

$$V_y = V_y(0) - \frac{I_{in}}{C_p}t \qquad \text{Equation (1)}$$

in which $V_y(0)$ is a Y electrode voltage $V_y$ when the switch SW is turned on, and $C_p$ is capacitance of the panel capacitance Cp.

Referring to FIG. 4C, the voltage $V_g$ applied to the discharge space 50 when no discharge occurs while the switch SW is turned on is calculated, assuming that the voltage applied to the Y electrode 10 is $V_{in}$.

When the voltage of $V_{in}$ is applied to the Y electrode 10, a charge of $-\sigma_t$ is applied to the Y electrode 10, and a charge of $+\sigma_t$ is applied to the X electrode 20. By applying the Gaussian theorem, the electric field $E_1$ within the dielectric layers 30 and 40 and the electric field $E_2$ within the discharge space 50 are given by Equations (2) and (3).

$$E_1 = \frac{\sigma_t}{\varepsilon_r \varepsilon_0} \qquad \text{Equation (2)}$$

in which $\sigma_t$ represents the charges applied to the Y and X electrodes, and $\epsilon_0$ is the permittivity within the discharge space.

$$E_2 = \frac{\sigma_t + \sigma_w}{\varepsilon_0} \qquad \text{Equation (3)}$$

The voltage of $(V_e - V_{in})$ applied outside the discharge cell is given by Equation (4), which describes the relationship between the electric field and the distance, and the voltage of $V_g$ of the discharge space 50 is given by Equation 5.

$$2d_1E_1 + d_2E_2 = V_e - V_{in} \qquad \text{Equation (4)}$$

$$V_g = d_2E_2 \qquad \text{Equation (5)}$$

From Equations (2) to (5), the charges $\sigma_t$ applied to the X or Y electrode 10 or 20 and the voltage $V_g$ within the discharge space 50 are given by Equations (6) and (7).

$$\sigma_t = \frac{V_e - V_{in} - \frac{d_2}{\varepsilon_0}\sigma_w}{\frac{d_2}{\varepsilon_0} + \frac{2d_1}{\varepsilon_r \varepsilon_0}} = \frac{V_e - V_{in} - V_w}{\frac{d_2}{\varepsilon_0} + \frac{2d_1}{\varepsilon_r \varepsilon_0}} \qquad \text{Equation (6)}$$

where $V_w$ is a voltage formed by the wall charges $\sigma_w$ in the discharge space 50.

$$\begin{aligned} V_g &= \frac{\varepsilon_r d_2}{\varepsilon_r d_2 + 2d_1}(V_e - V_{in} - V_w) + V_w \\ &= \alpha(V_e - V_{in}) + (1 - \alpha)V_w \end{aligned} \qquad \text{Equation (7)}$$

Actually, because the internal length $d_2$ within the discharge space 50 is a very large value compared to the thickness $d_1$ of the dielectric layers 30 and 40, $\alpha$ almost reaches 1. That is, it is known from Equation (7) that the externally applied voltage of $(V_e - V_{in})$ is applied to the discharge space 50.

Next, referring to FIG. 4D, the voltage $V_{g1}$ within the discharge space 50 is calculated for the state in which the wall charges formed at the Y and X electrodes 10 and 20 are quenched by the amount of $\sigma_w'$ because of the discharge caused by the externally applied voltage of $(V_e-V_{in})$. The charges applied to the Y and X electrodes 10 and 20 are increased to $\sigma_t'$ since the charges are supplied from the power $V_{in}$ so as to maintain the potential of the electrodes when the wall charges are formed.

By applying the Gaussian theorem in FIG. 4D, the electric field $E_1$ within the dielectric layers 30 and 40 and the electric field E2 within the discharge space 50 are given by Equations (8) and (9).

$$E_1 = \frac{\sigma_t'}{\varepsilon_r \varepsilon_0} \quad \text{Equation (8)}$$

$$E_2 = \frac{\sigma_t' + \sigma_w - \sigma_w'}{\varepsilon_0} \quad \text{Equation (9)}$$

Using Equations (8) and (9), the charges $\sigma_t'$ applied to the Y and X electrodes 10 and 20 and the voltage $V_{g1}$ within the discharge space are given by Equations (10) and (11).

$$\sigma_t' = \frac{V_e - V_{in} - \frac{d_2}{\varepsilon_0}(\sigma_w - \sigma_w')}{\frac{d_2}{\varepsilon_0} + \frac{2d_1}{\varepsilon_r \varepsilon_0}} = \frac{V_e - V_{in} - V_w + \frac{d_2}{\varepsilon_0}\sigma_w'}{\frac{d_2}{\varepsilon_0} + \frac{2d_1}{\varepsilon_r \varepsilon_0}} \quad \text{Equation (10)}$$

$$V_{g1} = d_2 E_2 = \alpha(V_e - V_{in}) + (1-\alpha)V_w - (1-\alpha)\frac{d_2}{\varepsilon_0}\sigma_w' \quad \text{Equation (11)}$$

Since $\alpha$ is almost 1 in Equation (11), very little voltage falling is generated within the discharge space 50 when the voltage $V_{in}$ is externally applied to generate a discharge. Therefore, when the amount $\sigma_w'$ of the wall charges reduced by the discharge is very large, the voltage $V_{g1}$ within the discharge space 50 is reduced, and the discharge is quenched.

Next, referring to FIG. 4E, the voltage $V_{g2}$ within the discharge space 50 is calculated for the state in which the switch SW is turned off (i.e., the discharge space 50 is floated) after the wall charges formed at the Y and X electrodes 10 and 20 are quenched by the amount of $\sigma_w'$ because of the discharge caused by the externally applied voltage $V_{in}$. Since no external charges are applied, the charges applied to the Y and X electrodes 10 and 20 become a, in the same manner as described with respect to FIG. 4C. By applying the Gaussian theorem, the electric field $E_1$ within the dielectric layers 30 and 40 and the electric field $E_2$ within the discharge space 50 are given by Equations (2) and (12).

$$E_2 = \frac{\sigma_t + \sigma_w - \sigma_w'}{\varepsilon_0} \quad \text{Equation (12)}$$

Using Equations (12) and (6), the voltage $V_{g2}$ of the discharge space 50 is given by Equation (13).

$$V_{g1} = d_2 E_2 = \alpha(V_e - V_{in}) + (1-\alpha)V_w - \frac{d_2}{\varepsilon_0}\sigma_w' \quad \text{Equation (13)}$$

It is known from Equation (13) that a large voltage fall is generated by the quenched wall charges when the switch SW is turned off (floated). That is, as known from Equations (12) and (13), the voltage falling intensity caused by the wall charges in the floated state of the electrode becomes larger by a multiple of $1/(1-\alpha)$ times that of the voltage applying state. As a result, since the voltage within the discharge space 50 is substantially reduced in the floated state when a small amount of charges are reduced, the voltage between the electrodes becomes below the discharge firing voltage, and the discharge is steeply quenched. That is, floating the electrode after the discharge begins serves as an intense discharge quenching mechanism. When the voltage within the discharge space 50 is reduced, the voltage $V_y$ at the floated Y electrode is increased by a predetermined voltage, as shown in FIG. 3, since the X electrode is fixed at the voltage of $V_e$.

Referring to FIG. 3, when the Y electrode is floated in the state in which the Y electrode voltage falls to cause a discharge, the discharge is quenched while the wall charges formed at the Y and X electrodes are slightly reduced according to the discharge quenching mechanism. By repeating this operation, the wall charges formed at the Y and X electrodes are erased step by step, thereby controlling the wall charges to reach a desired state. That is, the wall charges are accurately controlled to achieve a desired wall charge state in the falling period $P_{r3}$ of the reset period $P_r$.

Figure 5:
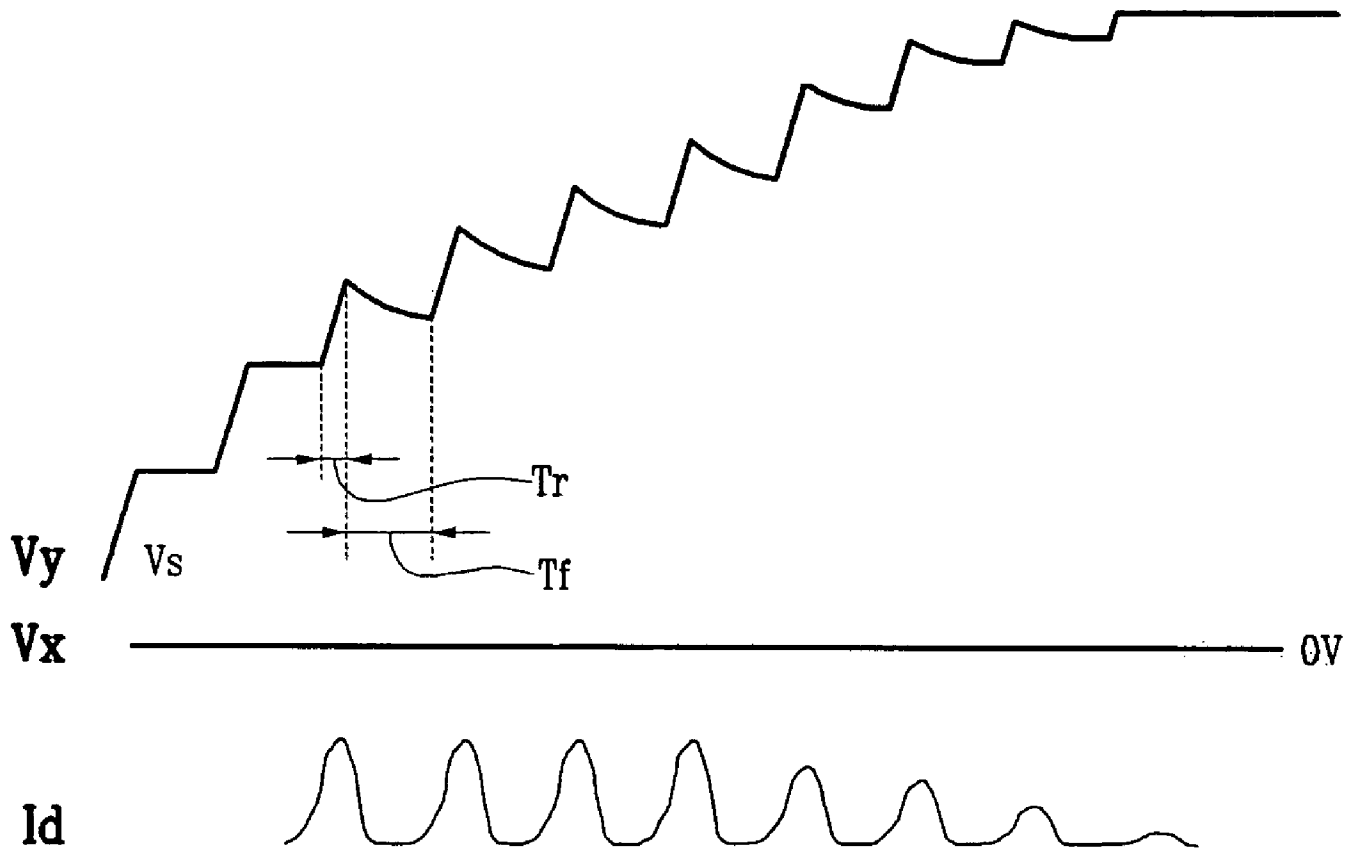
FIG. 5 is a waveform diagram illustrating a rising waveform and a discharge current according to an exemplary embodiment of the present invention.

This exemplary embodiment was described above using the falling period $P_{r3}$ of the reset period $P_r$, as an example. However, this exemplary embodiment is also applicable in cases in which control of wall charges using a falling waveform is desired, as well as cases in which control of wall charges using a rising waveform is desired. FIG. 5 illustrates a rising waveform with a firing period $T_r$ and a floating period $T_f$. For example, as shown in FIG. 5, a process according to the present invention may include raising the Y electrode voltage by a predetermined voltage during a firing period $T_r$ and floating the Y electrode by stopping the voltage applied to the Y electrode during the floating period $T_f$ in the rising period $P_{r2}$ of the reset period $P_r$.

Referring to FIGS. 6, 7, 8 and 9, a number of exemplary driving circuits for generating a falling waveform similar or identical to that shown in FIG. 3 will be described. These driving circuits may be provided in the Y electrode driver 500 and may provide the Y waveform shown in FIG. 2.

Figure 6:
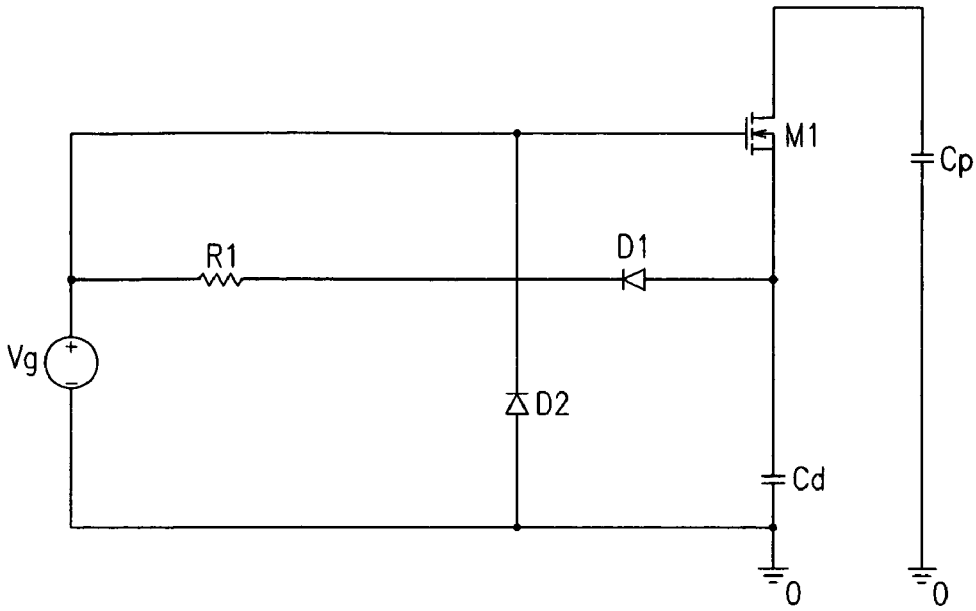
FIG. 6 is a circuit diagram of a driving circuit according to a first exemplary embodiment of the present invention.
Figure 7:
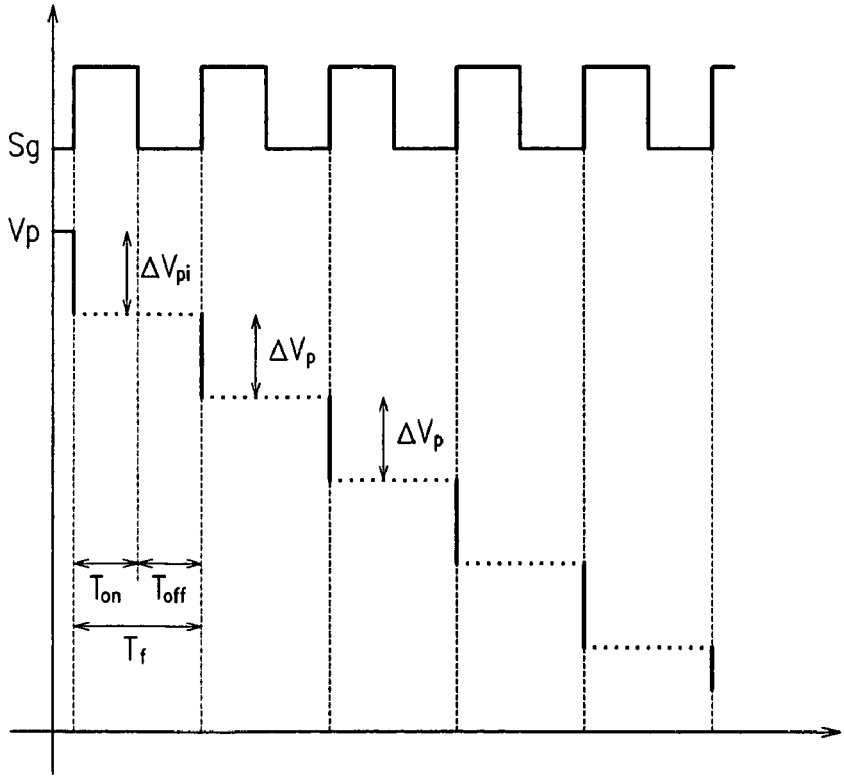
FIG. 7 a waveform diagram illustrating a driving waveform of the driving circuit of FIG. 5.
Figure 8:
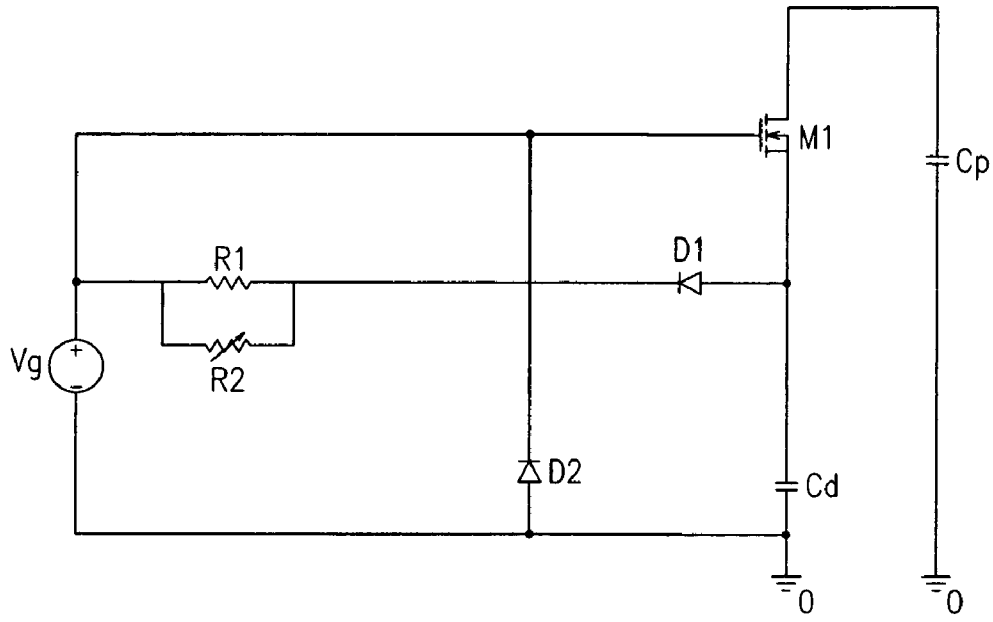
FIGS. 8, 9, 10, 11, 12, 13, 14, 15, and 16 are circuit diagrams of driving circuits according to second, third, fourth, fifth, sixth, seventh, eighth, ninth, and tenth exemplary embodiments of the present invention, respectively.
Figure 9:
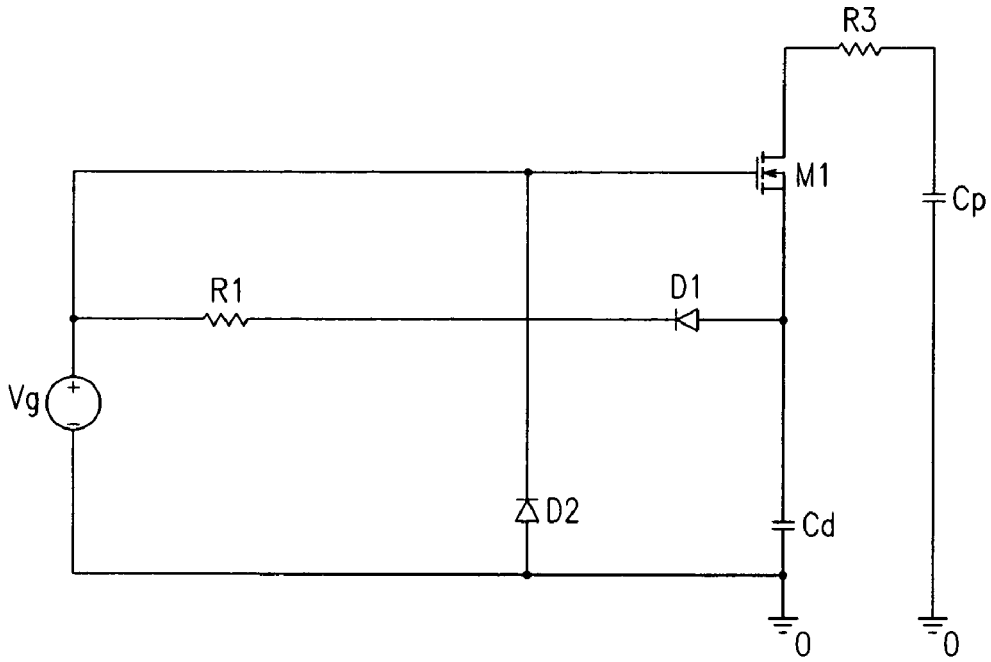

FIG. 6 is a circuit diagram illustrating a driving circuit according to a first exemplary embodiment of the present invention, and FIG. 7 shows a driving waveform diagram of the driving circuit of FIG. 6. FIGS. 8 and 9 are circuit diagrams of driving circuits according to second and third exemplary embodiments of the present invention, respectively. The panel capacitor Cp shown in FIGS. 6, 8, and 9 represents the capacitive load between the Y and X electrode, as it does in FIG. 4A. It is assumed that a ground voltage is applied to a second end of the panel capacitor Cp (i.e., the X electrode), and that the panel capacitor Cp is charged with a predetermined amount of charges.

As shown in FIG. 6, a driving circuit according to the first exemplary embodiment includes a transistor M1, a capacitor Cd, a resistor R1, diodes D1 and D2, and a control signal voltage source Vg. A drain, which is one of two main ends of the transistor M1, is connected to a first end of the panel capacitor Cp, and a source, which is the other main end of the transistor M1, is connected to a first end of the capacitor Cd. A second end of the capacitor Cd is connected to the ground 0. The control signal voltage source Vg is connected between a gate, which is the control end of the transistor M1, and the ground 0, and supplies a control signal Sg to the transistor M1.

The diode D1 and the resistor R1 are connected between the first end of the capacitor Cd and the control signal voltage source Vg, and form a discharging path allowing the capacitor Cd to be discharged. The diode D2 is connected between the ground 0 and the gate of the transistor M1, and clamps the gate voltage of the transistor M1. A resistor (not shown) may is optionally be connected between the control signal voltage source Vg and the transistor M1, and a resistor (not shown) may be also connected between the gate of the transistor M1 and the ground 0.

In FIG. 6, the transistor M1 is depicted as an n channel MOSFET, but any other switching element performing similar functions can be used instead of the n channel MOSFET.

Next, the operation of the driving circuit of FIG. 6 will be described with reference to FIG. 7. For ease of description, it is assumed that no discharge is generated in the waveform of FIG. 7. If a discharge occurs, the waveform of FIG. 7 would be produced such that the voltage of Vp is increased in the floating period, as shown in the waveform of FIG. 3.

As shown in FIG. 7, the control signal Sg supplied by the control signal voltage source Vg alternately has a high level voltage for turning on the transistor M1, and a low level voltage for turning off the transistor M1.

When the control signal Sg becomes a high level voltage appropriate to turn on the transistor M1, the charges accumulated in the panel capacitor Cp are moved to the capacitor Cd. When the capacitor Cd is charged, the first end voltage of the capacitor Cd rises so that the source voltage of the transistor M1 rises. At this time, the gate voltage of the transistor M1 is maintained at the voltage at the time of turning on the transistor M1, but the first end voltage of the capacitor Cd rises. Therefore, the source voltage of the transistor M1 rises as compared to the gate voltage of the transistor M1. When the source voltage of the transistor M1 rises to a predetermined voltage, the voltage between the gate and the source (referred to as the gate-source voltage hereinafter) of the transistor M1 is lower than the threshold voltage $V_t$ of the transistor M1 so that the transistor M1 is turned off.

That is, the transistor M1 is turned off when the difference between the high level voltage of the control signal Sg and the source voltage of the transistor M1 is lower than the threshold voltage $V_t$ of the transistor M1. When the transistor M1 is turned off, the voltage applied to the panel capacitor Cp is stopped so that the panel capacitor Cp is floated. The amount of charges $\Delta Q_i$ charged in the capacitor Cd is given by Equation (14) when the transistor M1 is turned off.

$$\Delta Q_i = C_d(V_{cc} - V_t) \qquad \text{Equation (14)}$$

in which $V_{cc}$ is the high level voltage of the control signal Sg, and $C_d$ is the capacitance of the capacitor Cd.

In addition, the voltage of the panel capacitor Cp is immediately reduced by the predetermined voltage because the charges are immediately moved from the panel capacitor Cp to the capacitor Cd. Therefore, the panel capacitor Cp can be floated faster than the case in which the panel capacitor is floated by controlling the level of the control signal Sg. Furthermore, the floating period $T_f$ can be longer than the voltage applying period since the transistor M1 is still turned off when the control signal Sg is at the low level.

The voltage variation $\Delta V_{pi}$ of the panel capacitor Cp is given by Equation (15) since the charges $\Delta Q_i$ charged in the capacitor Cd are supplied from the panel capacitor Cp.

$$\Delta V_{pi} = \frac{\Delta Q_i}{C_p} = \frac{C_d}{C_p}(V_{cc} - V_t) \qquad \text{Equation (15)}$$

Next, when the control signal becomes a low level voltage, the capacitor Cd is discharged through the path including the capacitor Cd, the diode D1, the resistor R1 and the control signal voltage source Vg since the first end voltage of the capacitor Cd is higher than the positive polarity voltage of the control signal voltage source Vg. Because the capacitor Cd is discharged in the state that the capacitor Cd is charged to $(V_{cc}-V_t)$ voltage, the amount $\Delta V_d$ of the reduced voltage of the capacitor Cd by the discharge is given by Equation (16).

$$\Delta V_d = (V_{cc} - V_t)e^{-\frac{1}{R_1 C_d}t} \qquad \text{Equation (16)}$$

where $R_1$ is the resistance of the resistor R1.

In addition, the amount of charges $\Delta Q_d$ discharged from the capacitor Cd is given by Equation (17) in terms of the low level time $T_{off}$ of the control signal Sg. The amount of charges $Q_d$ remaining in the capacitor Cd is given as Equation (18).

$$\Delta Q_d = C_d(V_{cc} - V_t) - C_d(V_{cc} - V_t)e^{-\frac{1}{R_1 C_d}T_{off}} = C_d(V_{cc} - V_t)\left(1 - e^{-\frac{1}{R_1 C_d}T_{off}}\right) \qquad \text{Equation (17)}$$

$$Q_d = \Delta Q_i - \Delta Q_d \qquad \text{Equation (18)}$$

Next, when the control signal Sg becomes the high level voltage again, the transistor M1 is turned on so that the charges are moved from the panel capacitor Cp to the capacitor Cd. As was described above, the transistor M1 is turned off when the capacitor Cd is charged to the charges $\Delta Q_i$. Therefore, the transistor M1 is turned off when the charges $\Delta Q_i$ are moved from the panel capacitor Cp to the capacitor Cd. As a result, the amount $\Delta V_p$ of the reduced voltage of the panel capacitor Cp is given as Equation (19).

$$\Delta V_p = \frac{\Delta Q_d}{C_p} = \frac{C_d}{C_p}(V_{cc} - V_t)\left(1 - e^{-\frac{1}{R_1 C_d}T_{off}}\right) \qquad \text{Equation (19)}$$

As was described above, when the voltage of the panel capacitor Cp is reduced by $\Delta V_p$, the voltage of the capacitor Cd rises so that the transistor M1 is turned off. When the control signal Sg becomes the low level voltage, the capacitor Cd is discharged, and the transistor M1 remains in the turned-off state. Therefore, the voltage of the panel capacitor Cp is once again reduced in response to the high level of the control signal Sg and the panel capacitor Cp is once again floated in response to the rising of voltage of the capacitor Cd. In general, the task of reducing the voltage of the electrode and floating the electrode can be repeated.

As an example, it may be assumed for purposes of this description that in the driving circuit shown in FIG. 6, the capacitance Cp of the panel capacitor Cp is about 0.1 μF. With that panel capacitance, if the capacitor Cd has a capacitance Cd of 0.2 μF, the resistor R1 has a resistance $R_1$ of 2.2 Ω, the control signal Sg has a high level voltage Vcc of 15V, the high level time $T_{on}$ is 600 ns and the low level time $T_{off}$ is 600 ns, the voltage of the panel capacitor Cp may be reduced by about 220V during the period Pr3, which lasts about 100 μs. As those of skill in the art will realize, the above is only one example of the characteristics of the components and the lengths of the periods in embodiments of the invention; components with other characteristics and periods of different lengths may be used.

In the first exemplary embodiment of the present invention, a discharge path is formed in order to facilitate repeatedly reducing the voltage of the electrode and floating the electrode, but the discharge path can be removed if reducing the voltage of the electrode and floating the electrode are only performed once. In addition, the discharge path may not be connected to the positive polarity terminal of the control signal voltage source Vg but may instead be formed by a different path. For example, a switching element is connected between the first end of the capacitor Cd and the ground 0, and the switching element is turned on so as to form the discharge path.

Furthermore, as can be seen in Equation (19), the amount of voltage reduction in the panel capacitor C1 is controlled by controlling the duty ratio of the control signal Sg, since the reduced voltage of the panel capacitor Cp is determined by the resistor R1 and the low level period $T_{off}$ of the control signal Sg.

As shown in FIG. 8, in the second exemplary embodiment of the present invention, the amount of the reduced voltage of the panel capacitor Cp is controlled by the resistance of the variable resistor R2 connected to the resistor R1 in parallel. In addition, the variable resistor R2 may be connected instead of the resistor R1.

Furthermore, as shown in FIG. 9, in the third exemplary embodiment of the present invention, a resistor R3 is connected between the panel capacitor Cp and the transistor M1 so as to restrict the current discharged from the panel capacitor Cp. In addition, any other element which can restrict the current discharged from the panel capacitor Cp, for example, an inductor (not shown), can be used instead of the resistor R3.

In the driving circuit described in FIGS. 6, 8, and 9, when the voltage of the panel capacitor Cp is reduced to less than a predetermined voltage, the amount of charges moved from the panel capacitor Cp to the capacitor Cd is also reduced so that the voltage of the capacitor Cd is lower than $(V_{cc}-V_t)$ voltage. As a result, the floating period $T_{off}$ becomes short since the transistor M1 is not turned off by the voltage of the capacitor Cd. In addition, the voltage discharged from the capacitor Cd is also reduced as described in Equation (16) when the voltage of the capacitor Cd is lower than $(V_{cc}-V_t)$ voltage. Therefore, the amount of charges moved from the panel capacitor Cp to the capacitor Cd is reduced when the transistor M1 is turned on. As a result, in the driving circuits of FIGS. 6, 8, and 9, the level of the reduced voltage decreases at the end region of the falling waveform shown in FIG. 3 so that the voltage of the panel capacitor Cp may not be reduced to the desired voltage during the given time.

A driving circuit according to the exemplary embodiment which can shorten the time in the end region of the falling waveform will be described with reference to FIG. 10.

Figure 10:
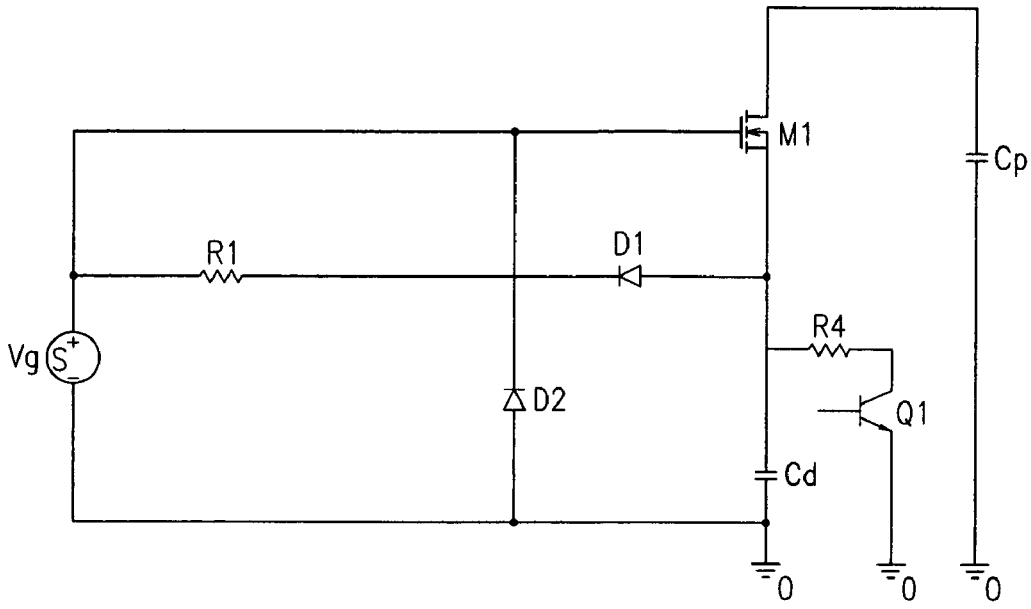

FIG. 10 is a circuit diagram of a driving circuit according to a fourth exemplary embodiment of the present invention.

As shown in FIG. 10, the driving circuit according to the fourth exemplary embodiment further includes a transistor Q1 different from that of the first exemplary embodiment. The collector, which is a first end of the transistor Q1, is connected to the first end of the capacitor Cd, and the emitter, which is a second end of the transistor Q1, is connected to the ground 0. That is, the transistor Q is connected to the capacitor Cd in parallel. In FIG. 10, the transistor Q1 is depicted as an npn type bipolar transistor but a pnp type bipolar transistor may be used as the transistor Q1. In addition, any other switching elements performing similar functions can be used instead of the transistor Q1.

The operation of the driving circuit shown in FIG. 10 is same as that of the driving circuit shown in FIG. 6 during the early stage. That is, the transistor Q1 is turned off during the early stage. As was described above, when the voltage of the panel capacitor Cp is lower than the predetermined voltage so that the amount of charges moved from the panel capacitor Cp to the capacitor Cd is reduced, the signal for turning on the transistor is applied to the base, which is the control end of the transistor Q1. Then, the transistor Q1 is turned on so that the voltage of the capacitor Cd is discharged to the ground 0 through the transistor Q1. In addition, the voltage of the panel capacitor Cp is steeply reduced to the desired voltage since the voltage charged in the panel capacitor Cp is discharged through the turned on transistor Q1.

As shown in FIG. 10, a resistor R4 may be connected between the first end of the capacitor Cd and the first end of the transistor Q1 and/or between the second end of the transistor Q1 and the ground 0. Then, the voltage of the panel capacitor Cp is not steeply reduced when turning on the transistor Q1, but is reduced according to a time constant which is determined by the parallel connection of the resistor R4 and the capacitor Cd. In addition, the transistor Q1 may be turned on a predetermined length of time after the control signal Sg is applied to the transistor M1.

Furthermore, the transistor Q1 described in FIG. 10 may be used in the driving circuits shown in FIGS. 8 and 9.

Figure 11:
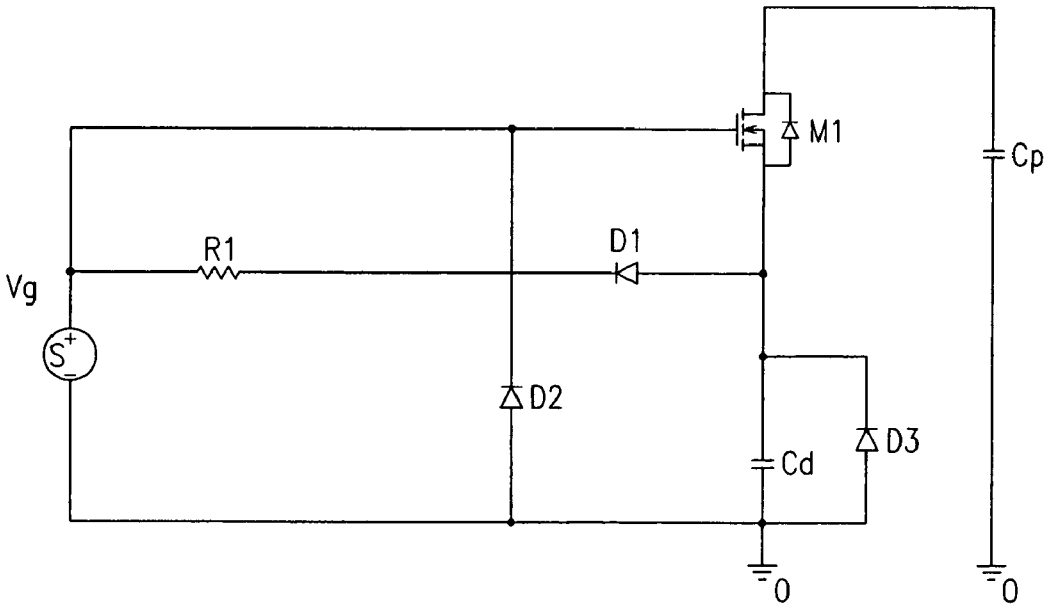

In the driving circuits described in FIGS. 6, 8, 9, and 10, the current flowing from the first end of the capacitor Cd to its second end is controlled by the gate-source voltage of the transistor M1 since the transistor M1 is turned off when the capacitor Cd is charged to the predetermined voltage. However, because the body diode is formed in the transistor M1 in a direction from the source to the drain, as shown in FIG. 11, when the MOSFET is used as the transistor M1, the current may flow from the second end of the capacitor Cd to its first end when the voltage of the panel capacitor Cp is lower than voltage of the voltage source to which the capacitor Cd is connected (the voltage source is ground 0 in FIGS. 6, 8, 9, and 10). In addition, the capacitor Cd may be charged continuously because there is no means for controlling this current in the driving circuits shown in FIGS. 6, 8, 9, and 10. Then, the second end voltage of the capacitor Cd is higher than the first end voltage of the capacitor Cd by an amount equal to the voltage charged in the capacitor Cd, so that the gate voltage of the transistor M1 is higher than the first end voltage of the capacitor Cd (i.e., the source voltage of the transistor M1 caused by the voltage charged in the capacitor Cd). As a result, the gate-source voltage of the transistor M1 rises by the voltage charged in the capacitor Cd, and the transistor M1 may be damaged if this voltage is higher than the voltage that the transistor M1 can withstand.

A driving circuit according to another exemplary embodiment, which can prevent the transistor M1 from being damaged by the current flowing from the second end of the capacitor Cd to the first end of it, will be described with reference to FIGS. 11 and 12.

Figure 12:
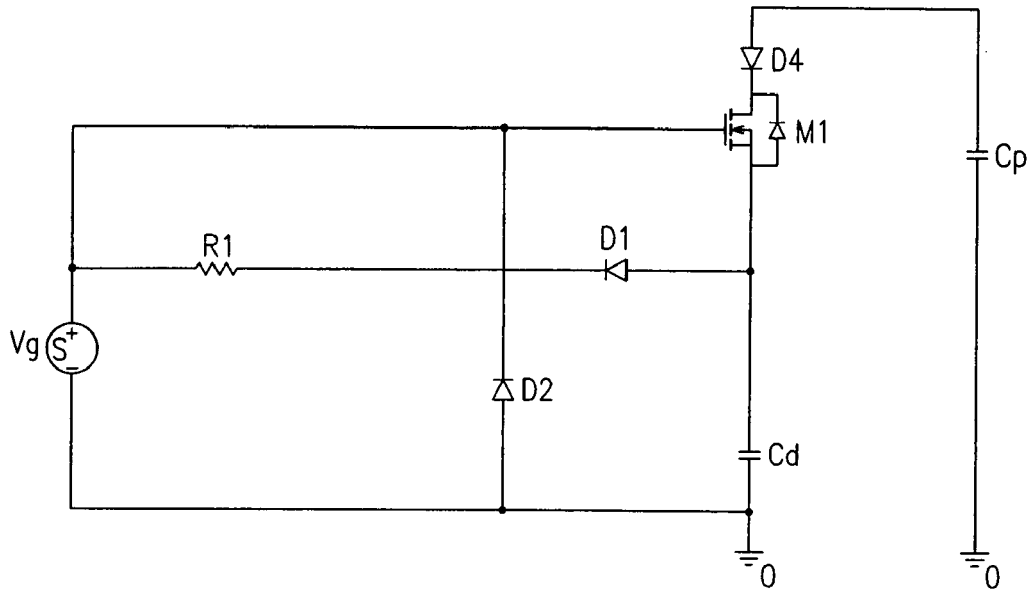

FIGS. 11 and 12 are circuit diagrams of the driving circuits according to fifth and sixth exemplary embodiments of the present invention, respectively.

Referring to FIG. 11, the driving circuit according to the fifth exemplary embodiment further includes a diode D3 connected to the capacitor Cd in parallel differently from the driving circuit according to the first exemplary embodiment shown in FIG. 6. In particular, the anode of the diode D3 is connected to the second end of the capacitor Cd, and the cathode of the diode D3 is connected to the first end of the capacitor Cd. In this arrangement, the current generated by the body diode of the transistor M1 when the second voltage of the capacitor Cd is higher than the voltage of the panel capacitor Cp flows through the diode D3. Therefore, the capacitor Cd is not charged by this current. As a result, the gate-source voltage of the transistor M1 is never higher than the maximum voltage that the transistor M1 can withstand.

Referring to FIG. 12, the driving circuit according to the sixth exemplary embodiment further includes a diode D4 connected between the capacitor Cd and the transistor M1 differently from the driving circuit according to the first exemplary embodiment shown in FIG. 6. In particular, the anode of the diode D4 is connected to the first end of the panel capacitor Cp, and the cathode of the diode D4 is connected to the drain of the transistor M1. Then, the current which can be generated by the body diode of the transistor M1 is intercepted since the diode is formed in the opposite direction of the body diode of the transistor M1. In FIG. 12, the diode D4 is connected between the panel capacitor Cp and the transistor M1, but the diode D4 may be formed in any position of the path including the panel capacitor Cp, the transistor M1, and the capacitor Cd.

The above description concerns the case that the panel capacitor Cp is discharged in order to generate the falling waveform shown in FIG. 3. The present invention is also applicable to the case in which the panel capacitor Cp is charged in order to generate the rising waveform shown in FIG. 5. These exemplary embodiments will be described with reference to FIGS. 13 to 16.

FIGS. 13 to 16 are circuit diagrams of driving circuits according to seventh to tenth exemplary embodiments of the present invention, respectively. Since the configurations and the operations of the circuits of FIGS. 13 to 16 are similar to those of FIGS. 6, 10, 11, and 12, respectively, only differences between the circuits of FIGS. 6, 10, 11, and 12 and those of FIGS. 13 to 16 will be described, and the same portions or those which are readily apparent from FIGS. 6, 10, 11, and 12 will be omitted.

Figure 13:
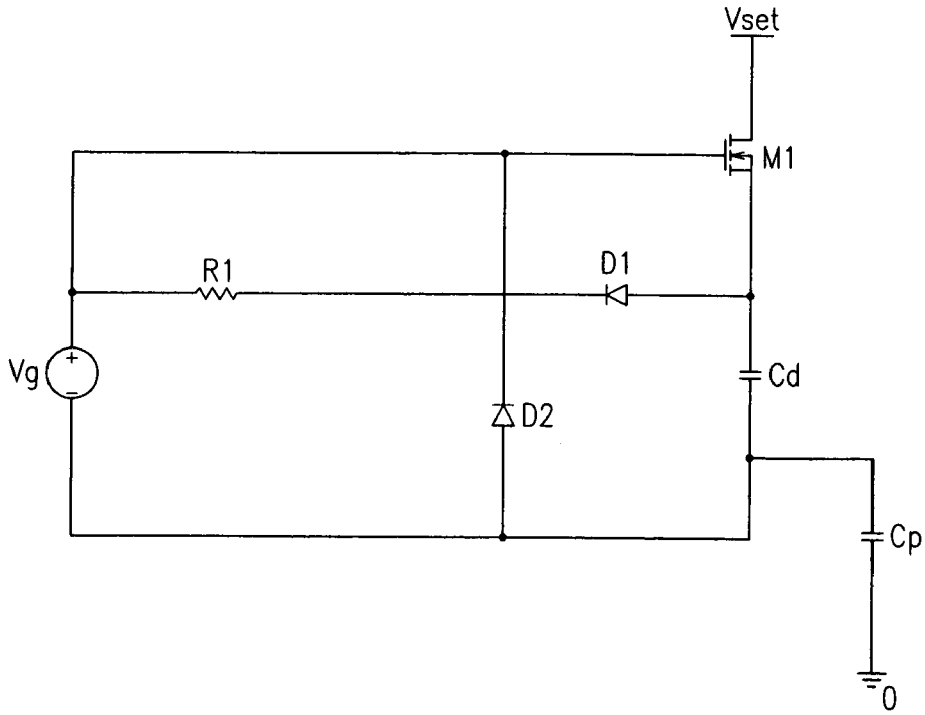

As shown in FIG. 13, in the driving circuit according to the seventh exemplary embodiment, the drain of the transistor M1 is connected to the voltage source supplying the high voltage $V_{set}$. The capacitor Cd is connected between the source of the transistor M1 and the first end of the panel capacitor Cp (i.e., the Y electrode). When the transistor M1 is turned on, the capacitor Cd and the panel capacitor Cp are charged by the $V_{set}$ voltage. The transistor M1 is turned off when the voltage of the capacitor Cd increases to a predetermined voltage.

In the driving circuit of FIG. 13, when the voltage of the panel capacitor Cp increases higher than a predetermined voltage, the amount of the charges moved to the panel capacitor Cp is reduced. As a result, the voltage rise is reduced in the end region of the rising waveform so that the voltage of the panel capacitor Cp may not rise to the desired voltage during the given time. Therefore, the transistor Q1 described in FIG. 10 can be included in the driving circuit of FIG. 13. This exemplary embodiment will be described with reference to FIG. 14.

Figure 14:
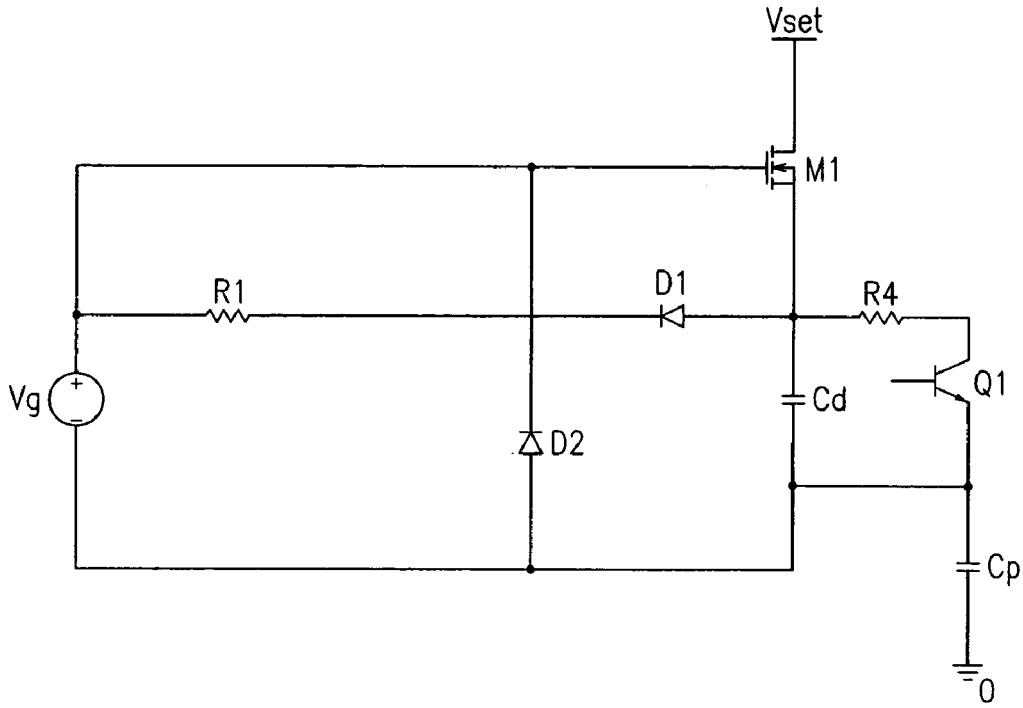

Referring to FIG. 14, the driving circuit according to the eighth exemplary embodiment further includes a transistor Q1. The first end of the transistor Q1 is connected to the first end of the capacitor CD, and the second end of the transistor Q1 is connected to the panel capacitor Cp. That is, the transistor Q1 is connected to the capacitor Cd. The voltage of the panel capacitor Cp steeply increases to the desired voltage within the given time since the $V_{set}$ voltage is applied to the panel capacitor through the transistors M1 and Q1 when the transistors Q1 and M1 are turned on. In addition, the resistor R4 may be connected between the first end of the capacitor Cd and the first end of the transistor Q1 and/or between the second end of the transistor Q1 and the panel capacitor Cp as described in FIG. 10. Then, the voltage of the panel capacitor Cp is reduced according to the time constant, which is determined by the parallel connection of the capacitor Cd and the resistor R4.

Furthermore, in the driving circuit of FIG. 13, the current may flow from the second end of the capacitor Cd to its first end by the body diode of the transistor M1 so that the transistor may be damaged. Therefore, the diode D3 or D4 described in FIG. 11 or 12 may be included in the driving circuit of FIG. 13. This exemplary embodiment will be described with reference to FIGS. 15 and 16.

Figure 15:
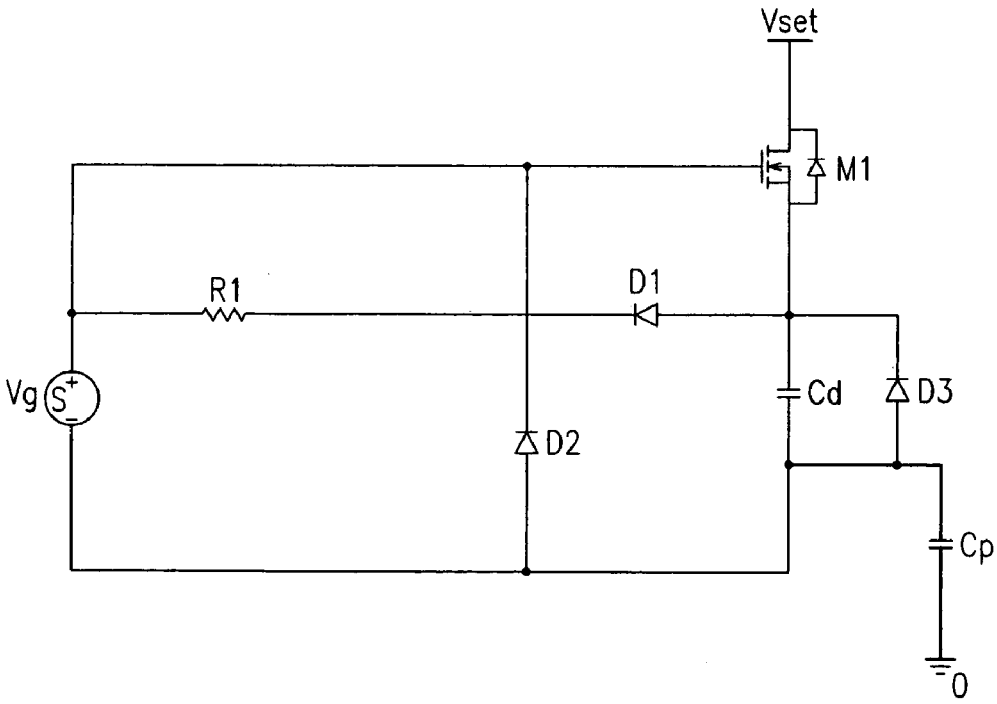

As shown in FIG. 15, the driving circuit according to the ninth exemplary embodiment further includes a diode D3. The anode of the diode D3 is connected to the second end of the capacitor Cd, and the cathode of the diode D3 is connected to the first end of the capacitor Cd. Consequently, the current generated by the body diode of the transistor M1 flows through the diode D3 so that the capacitor Cd is not charged by this current. As a result, the gate-source voltage of the transistor M1 is never higher than the voltage that the transistor M1 can withstand.

Figure 16:
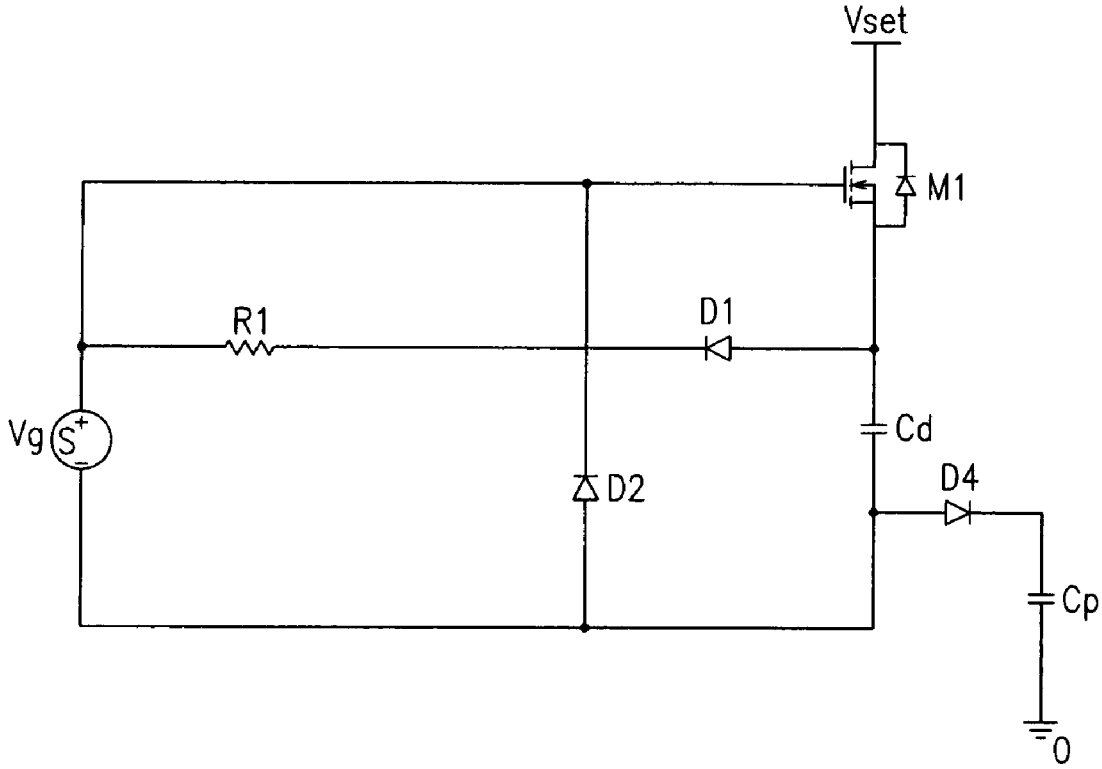

As shown in FIG. 16, the driving circuit according to the tenth exemplary embodiment further includes a diode D4. The anode of the diode D4 is connected to the second end of the capacitor Cd, and the cathode of the diode D3 is connected to the first end of the panel capacitor Cp. Consequently, the current that is generated by the body diode of the transistor M1 is intercepted by the diode D4, which is formed in the opposite direction of the body diode of the transistor M1. In addition to the configuration shown, the diode D4 may be formed in any position of the path including the voltage source supplying $V_{set}$ voltage, the transistor M1, the capacitor Cd, and the panel capacitor Cp.

Embodiments of the present invention provide a driving circuit for repeatedly floating the electrode after making the voltage applied to the electrode rise or fall. Additionally, in embodiments of the invention, the wall charges formed at the discharge cell are precisely controlled by the floating operation.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving device for a plasma display panel having a capacitive load formed by at least two electrodes, comprising:

a transistor having a first main end coupled to the capacitive load, a second main end coupled to a voltage source for supplying a first voltage, and a control end, the transistor being turned on in response to a first level of a control signal applied to the control end; and a capacitor provided in a path including the capacitive load, the transistor, and the voltage source;

wherein a voltage of the capacitive load is changed by discharging charges accumulated at the capacitive load to the capacitor when the transistor is turned on, and wherein the transistor is turned off when the capacitor is charged to a second voltage by accumulating the charges discharged from the capacitive load.

2. The driving device of claim 1, wherein the transistor is turned off by the difference between the second voltage charged to the capacitor and a control end voltage of the transistor caused by the first level of the control signal.

3. The driving device of claim 1, further comprising a discharge path coupled to a first end of the capacitor, the discharge path to discharge at least a portion of the second voltage charged to the capacitor.

4. The driving device of claim 3, wherein the voltage of the capacitive load and the voltage of the capacitor are changed by turning on the transistor after the capacitor is discharged.

5. The driving device of claim 3, wherein the discharge path is opened in response to a second level of the control signal.

6. The driving device of claim 5, wherein the control signal alternately has the first level and the second level.

7. The driving device of claim 5, wherein the second level of the control signal is a level for turning off the transistor.

8. The driving device of claim 3, wherein the discharge path comprises a resistor, and the capacitor is discharged along the path formed by the capacitor and the resistor.

9. The driving device of claim 8, wherein the resistor is a variable resistor.

10. The driving device of claim 3, wherein the discharge path further comprises a diode having an anode coupled to the first end of the capacitor.

11. The driving device of claim 3, further comprising a control signal voltage source to output the control signal;

wherein the discharge path is coupled between the first end of the capacitor and a positive polarity terminal of the control signal voltage source.

12. The driving device of claim 11, wherein a second end of the capacitor is coupled to a negative polarity terminal of the control signal voltage source.

13. The driving device of claim 3, further comprising a switching element having a first end coupled to the first end of the capacitor and a second end coupled to the second end of the capacitor.

14. The driving device of claim 13, wherein the switching element is turned on when the voltage of the capacitive load is a third voltage.

15. The driving device of claim 13, wherein the switching element is turned on a predetermined length of time after the control signal is applied to the control end of the transistor.

16. The driving device of claim 3, further comprising a diode for blocking a current formed by a body diode of the transistor.

17. The driving device of claim 16, wherein the diode is coupled to the capacitor in parallel, and is provided in the same direction of the body diode of the transistor.

18. The driving device of claim 16, wherein the diode is provided in the path including the capacitive load, the transistor, and the voltage source, and is oriented in the opposite direction from the body diode of the transistor.

19. The driving device of claim 3, wherein the voltage of the capacitive load is reduced by turning on the transistor, and the capacitor is coupled between the second main end of the transistor and the voltage source.

20. The driving device of claim 3, wherein the voltage of the capacitive load is increased by turning on the transistor, and the capacitor is coupled between the first main end of the transistor and the voltage source.

21. The driving device of claim 1, further comprising an element which restricts the current from the capacitive load to the capacitor coupled between the capacitive load and the first main end of the transistor.

22. A driving device of a plasma display panel having a capacitive load formed by at least two electrodes, comprising:

a transistor having a first main end coupled to the capacitive load;

a capacitor having a first end coupled to a second main end of the transistor and a second end coupled to a voltage source to supply a first voltage;

a control voltage source to supply a control voltage to a control end of the transistor; and a discharge path having a first end coupled to the first end of the capacitor, wherein the state of the transistor is determined by the first end voltage of the capacitor, and if the transistor is turned on, charges accumulated at the capacitive load are discharged to the capacitor, and wherein the transistor is turned off when the capacitor is charged to a turn-off voltage by accumulating the charges discharged from the capacitive load.

23. The driving device of claim 22, wherein the discharge path is provided such that a second end voltage of the discharge path is lower than the first end voltage of the capacitor.

24. The driving device of claim 22, wherein the discharge path comprises a diode having an anode coupled to the first end of the capacitor.

25. The driving device of claim 22, wherein a second end of the discharge path is coupled to a positive polarity terminal of the control voltage source.

26. The driving device of claim 25, wherein a negative polarity terminal of the control voltage source is coupled to the voltage source.

27. The driving device of claim 22, wherein the control voltage alternately has a second voltage and a third voltage, the second voltage is a voltage for turning on the transistor, thereby discharging charges from the capacitive load during a discharge period, and the third voltage is a voltage lower than the first end voltage of the capacitor during the discharge period.

28. The driving device of claim 22, further comprising a switching element having a first end coupled to the first end of the capacitor and forming a path through which the capacitor and the panel capacitor are discharged.

29. The driving device of claim 28, wherein the switching element is turned on when the voltage of the capacitive load is a predetermined voltage.

30. The driving device of claim 28, wherein the switching element is turned on a predetermined length of time after the control signal is applied to the control end of the transistor.

31. The driving device of claim 22, further comprising a diode having a cathode coupled to the first end of the capacitor and an anode coupled to the second end of the capacitor.

32. The driving device of claim 22, further comprising a diode coupled to at least one location selected from the group consisting of between the transistor and the capacitor, between the capacitor and the voltage source, and between the capacitor and the voltage source, oriented in an opposite direction from the body diode of the transistor.

33. A driving method of a plasma display panel having a capacitive load formed by at least two electrodes, comprising:

turning on a transistor having a first main end coupled to the capacitive load to discharge the capacitive load; and turning off the transistor when the capacitive load is discharged of a first amount of charges, wherein turning on the transistor further comprises discharging charges accumulated at the capacitive load to a capacitor, the transistor is turned off if a difference between a voltage applied to a control end of the transistor and a voltage of the capacitor is less than a threshold voltage of the transistor, and wherein the transistor is turned off when the capacitor is charged to a turn-off voltage by accumulating the charges discharged from the capacitive load.

34. The driving method of claim 33, further comprising moving the first amount of charges to the capacitor coupled to a second main end of the transistor, and wherein the transistor is turned off when the capacitor is charged to a turn-off voltage by accumulating the changes discharged from the capacitive load.

35. The driving method of claim 34, further comprising discharging the capacitor of a second amount of charges.

36. The driving method of claim 35, further comprising turning on the transistor after the capacitor is discharged of the second amount of charges.

37. The driving method of claim 35, further comprising repeating the method a predetermined number of times.

38. A driving method of a plasma display panel having a capacitive load formed by at least two electrodes, comprising:

changing a voltage of the capacitive load by using a first level of a control signal;

floating the capacitive load when the voltage of the capacitive load is changed by a predetermined voltage; and maintaining the floating state of the capacitive load by using a second level of the control signal, wherein the voltage of the capacitive load is changed by discharging charges accumulated at the capacitive load to a capacitor, the capacitor having a first end coupled to a source of a transistor that turns off to float the capacitive load, and wherein the transistor is turned off when the capacitor is charged to a turn-off voltage by accumulating the charges discharged from the capacitive load.

39. The driving method of claim 38, wherein the control signal alternatively has the first level and the second level.

* * * * *